United States Patent [19]

Yamada

[11] 4,248,186

[45] Feb. 3, 1981

[54] EXHAUST GAS RECIRCULATION CONTROL SYSTEM

[75] Inventor: Kinsaku Yamada, Katsuta, Japan

[73] Assignee: Hitachi, Ltd., Japan

[21] Appl. No.: 80,024

[22] Filed: Sep. 28, 1979

[30] Foreign Application Priority Data

Sep. 29, 1978 [JP] Japan ..... 53/120901
Dec. 20, 1978 [JP] Japan ..... 53/158338

[51] Int. Cl.[3] ..... F02B 47/08
[52] U.S. Cl. ..... 123/568
[58] Field of Search ..... 123/119 A

[56] References Cited

U.S. PATENT DOCUMENTS

| | | | |
|---|---|---|---|
| 3,814,070 | 6/1974 | Wertheimer | 123/119 A |
| 3,926,161 | 12/1975 | Wertheimer | 123/119 A |
| 3,931,813 | 1/1976 | Horie et al. | 123/119 A |
| 4,117,816 | 10/1978 | Minoura | 123/119 A |
| 4,165,722 | 8/1979 | Aoyama | 123/119 A |
| 4,183,333 | 1/1980 | Aoyama | 123/119 A |
| 4,193,381 | 3/1980 | Aoyama | 123/119 A |

*Primary Examiner*—Wendell E. Burns
*Attorney, Agent, or Firm*—Craig & Antonelli

[57] ABSTRACT

An E.G.R. control system includes a pressure modulator operative to modulate the magnitude of the port vacuum as applied to a diaphragm type actuator of an E.G.R. valve. The modulator comprises a housing and a diaphragm assembly disposed in the housing and consisting of a pair of diaphragms and a member connecting the diaphragms so that they are deformed simultaneously. The diaphragm assembly divides the interior of the housing into first, second and third chambers which are communicated with the engine carburetor venturi, vented to the atmosphere and communicated with the E.G.R. passage between the E.G.R. valve and a fixed restriction in the E.G.R. passage upstream of the E.G.R. valve, respectively, so that the diaphragm assembly is moved in response to variation in the venturi vacuum and also in response to variation in the exhaust gas pressure in the E.G.R. passage between the restriction and the E.G.R. valve. A valve member is mounted on the diaphragm assembly for movement therewith to control the flow of the atmospheric air from the second chamber into the E.G.R. valve actuator so that the port vacuum as applied to the E.G.R. valve actuator is modulated. The controlled flow of the recirculated exhaust gases through the E.G.R. passage from the exhaust pipe into the intake pipe is in proportion to the intake air flow.

7 Claims, 5 Drawing Figures

EXHAUST GAS RECIRCULATION CONTROL SYSTEM

BACKGROUND OF THE INVENTION

1. Field of the Invention

The present invention relates to an exhaust gas recirculation system for an internal combustion engine and, more particularly, to an exhaust gas recirculation control system which will be termed hereunder as "E.G.R. control system" for the simplification purpose.

2. Description of the Prior Art

An E.G.R. control system has been known which is of the type that comprises an E.G.R valve means including a first valve seat provided in an E.G.R. passage of an internal combustion engine, a first valve member cooperative with the first valve member to vary the exhaust gas flowing cross-section of the E.G.R. passage and a vacuum-operated actuator connected by a first pneumatic line to a first vacuum source provided by the engine, such as a port formed in the engine carburetor at a point just upstream of the idle position of the engine throttle valve, and a fixed restriction provided in the E.G.R. passage upstream of the first valve seat. The actuator is also operatively connected to the first valve member to move the same relative to the first valve seat for thereby varying the exhaust gas pressure in the E.G.R. passage between the fixed restriction and the first valve seat, so that the flow of the engine exhaust gases from the engine exhaust system through the E.G.R. passage back into the intake system is controlled by the E.G.R. valve means.

In order that the flow of the recirculated exhaust gases is so controlled as to be substantially in proportion to the flow of the engine intake air through the intake pipe, a pressure modulator has been used to modulate the port vacuum applied to the valve actuator so that the actuator is so operated as to vary the pressure difference across the fixed restriction in the E.G.R. passage in substantially proportion to the engine intake air flow through the intake pipe of the engine.

The prior art pressure modulator comprises a housing and a diaphragm assembly which includes three diaphragms which are mechanically connected together so that the diaphragms are moved in unison in response to a variation in the venturi vacuum and also in response to a variation in the exhaust gas pressure in the E.G.R. passage between the fixed restriction and the first valve seat. The diaphragm assembly cooperates with the housing to define therein first to fourth chambers. The first chamber is defined between the housing and the first diaphragm and is vented to the atmosphere and pneumatically connected to the first pneumatic line by a pressure modulating passage having an inner end surrounded by a second valve seat disposed in the first chamber. A second valve member is disposed in the first chamber and carried by the diaphragm assembly for movement toward and away from the second valve seat so that the flow of the atmospheric air from the first chamber through the pressure modulating passage into the first pneumatic line is varied in dependence on the position of the second valve member relative to the second valve seat. The second chamber is defined between the first and second diaphragms and connected to the carburetor venturi by a second pneumatic line. The third chamber is defined between the second and third diaphragms and is simply vented to the atmosphere. The fourth chamber is defined between the third diaphragm and the housing and is pneumatically connected to the E.G.R. passage between the fixed restriction and the first valve seat of the E.G.R. valve means.

The prior art pressure modulator is operative fairly well to control the supply of the vacuum to the E.G.R. valve actuator so that the recirculated exhaust gas flow through the E.G.R. passage from the exhaust pipe back into the intake pipe is substantially proportioned to the flow of the intake air through the carburetor venturi. The problem, however, is that the prior art pressure modulator is complicated in structure, large-sized and expensive. This is because of the use of three diaphragms to form the diaphragm assembly in the prior art pressure modulator.

SUMMARY OF THE INVENTION

It is an object of the present invention to provide an E.G.R. control system employing an improved pressure modulator which is of a simplified structure, of a compact size and can be manufactured at a low cost.

It is another object of the present invention to provide an improved pressure modulator in which a pair of diaphragms are sufficient to achieve the required pressure modulating performance.

It is a further object of the present invention to provide an improved pressure modulator of the class specified above and which has a housing made from a plastic material so that the pressure modulator as a whole is light-weighted and can be molded at a low cost.

The pressure modulator provided by the present invention for use in an E.G.R. control system of the known type referred to above comprises a housing and a diaphragm assembly movably disposed in the housing. The diaphragm assembly includes a pair of substantially parallel diaphragms and a member which mechanically connects the diaphragms together so that the diaphragms are deformed simultaneously. One of the diaphragms is larger than the other diaphragm. The larger diaphragm cooperates with the housing to define a first chamber pneumatically connected by a second pneumatic line to a second vacuum source which provides a pressure signal representing the flow of the intake air into the engine. The larger diaphragm also cooperates with the smaller diaphragm and with the housing to define a second chamber which is vented to the atmosphere. The smaller diaphragm cooperates with the housing to define a third chamber connected by a third pneumatic line to the E.G.R. passage between the fixed restriction and the first valve seat. The pressure modulator futher includes means defining a pressure modulating passage penumatically connecting the second chamber to the first vacuum line. The passage defining means also provides a second valve seat disposed in the second chamber and extending around the inner end of the pressure modulating passage. A spring means resiliently biases the diaphragm assembly away from the first chamber. A second valve member is disposed in the second chamber in opposite relationship to the second valve seat and carried by the diaphragm assembly for movement therewith toward and away from the second valve seat, whereby the second valve member is operative to control the flow of the atmospheric air from the second chamber through the second valve seat and the pressure modulating passage into the first pneumatic line to thereby modulate the vacuum from the first vacuum source as applied to the actuator.

The above and other objects, features and advantages of the present invention will be made more apparent by the following description with reference to the accompanying drawings.

DESCRIPTION OF PREFERRED EMBODIMENTS

Figure 1:
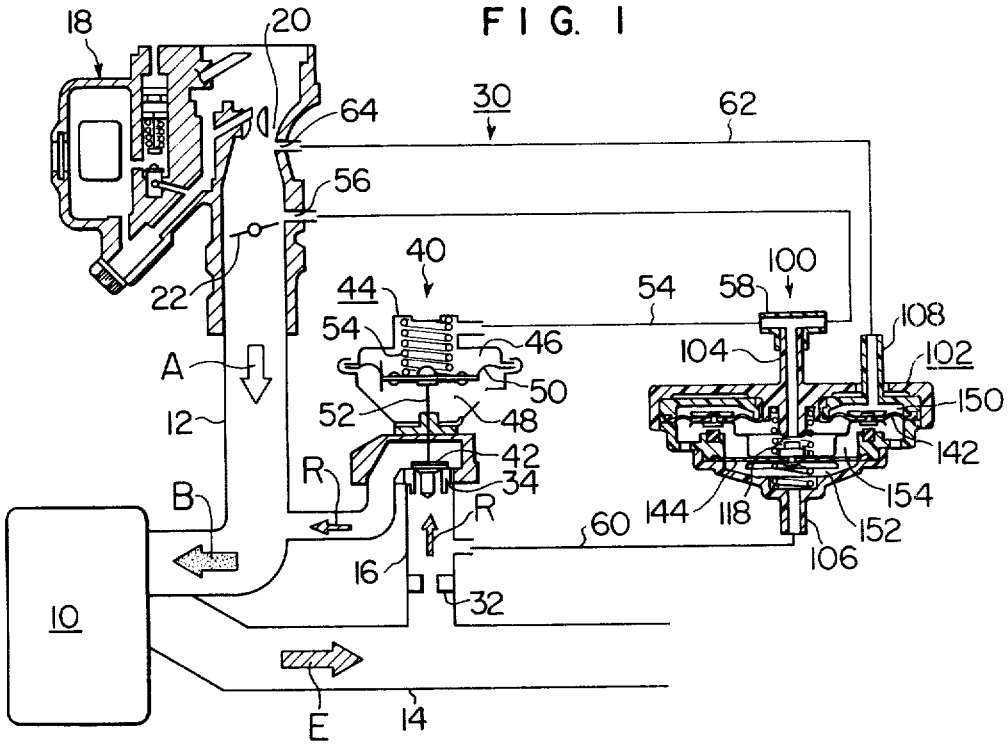
FIG. 1 is a partly sectional and partly diagrammatic illustration of an embodiment of an E.G.R. control system according to the present invention.

Referring first to FIG. 1, an internal combustion engine 10 has intake and exhaust pipes 12 and 14. An exhaust gas recirculation passage (hereinafter called "E.G.R. passage") 16 is provided between the intake and exhaust pipes 12 and 14 to recirculate the engine exhaust gases from the exhaust pipe 14 back into the intake pipe 12. The engine 10 is shown as being of the type that is provided with a carburetor 18 connected to the upstream end of the intake pipe 12. The carburetor 18 is shown as being of the downdraft type and provided with a venturi 20 and a throttle valve 22 disposed downstream of the venturi. The carburetor 18 is operative to produce a mixture of air and a fuel in conventional manner. The air-fuel mixture thus produced flows downwardly into the intake pipe 12, as shown by an arrow A. A part of the engine exhaust gases flowing through the exhaust pipe 14 as shown by an arrow E is recirculated therefrom back into the intake pipe 12 through the E.G.R. passage 16, as shown by small arrows R and is mixed with the air-fuel mixture A from the carburetor 18 to form a composite mixture which is shown by an arrow B and flows into the engine 10.

The flow of the recirculated exhaust gases through the E.G.R. passage 16 is controlled by an E.G.R. control system generally designated by reference numeral 30. The E.G.R. control system 30 includes an E.G.R. valve means 40 which comprises a valve member 42 disposed in the E.G.R. passage 16 downstream of a fixed restriction 32 provided therein. The valve member 42 is cooperative with a valve seat 34 in the E.G.R. passage 16 to vary the cross-section of the E.G.R. passage through which the engine exhaust gases are recirculated. For this purpose, the valve member 42 is actuated by a conventional diaphragm type actuator 44 having vacuum and atmospheric pressure chambers 46 and 48 which are partitioned by a diaphragm 50 which is mechanically connected by a rod 52 to the valve member 42. A compression coil spring 54 is disposed in the vacuum chamber 46 to resiliently bias the diaphragm 50 in a direction to close the valve member 42. The vacuum chamber 46 is pneumatically connected by a first vacuum line 54 to a first vacuum source provided by the engine 10. In the illustrated embodiment of the invention, the first vacuum source is a port 56 which is formed in the carburetor 18 at a point just above the idle position of the throttle valve 22, as shown in FIG. 1.

The vacuum produced at the port 56 (this vacuum will be termed as "port vacuum" hereunder) is modulated before the port vacuum is exerted to the actuator 44. For this purpose, a pressure modulator 100 is provided on the first vacuum line 54 between the port 56 and the actuator 44. The pressure modulator 100 comprises a generally top-shaped housing 102 provided with three ports 104, 106 and 108 extending therefrom. The first port 104 is disposed substantially centrally of the top of the housing 102 and pneumatically connected by a T-shaped connector 58 to the first vacuum line 54. The second port 106 is disposed at the apex of the top-shaped housing 102 and pneumatically connected by a line 60 to the E.G.R. passage 16 between the fixed restriction 32 and the E.G.R. valve means 40 (and, more particularly, the valve seat 34). The third port 108 extends from the top of the housing 102 between the center and the outer periphery of the top of the housing 102 and is pneumatically connected by a line 62 to a port 64 formed in the carburetor 18 at the venturi 20 thereof. It is apparent to those in the art that the pressure or vacuum level at the venturi port 64 is a function of the total flow of the air passing through the venturi 20 into the engine 10.

Figure 2:
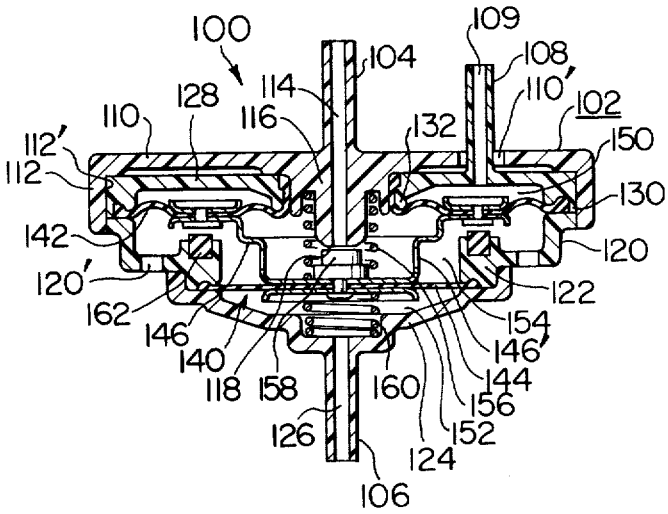
FIG. 2 is an enlarged axial sectional view of a pressure modulator employed in the embodiment of the invention shown in FIG. 1.

Referring to FIG. 2, the pressure modulator 100 will be described in more detail. The housing 102 of the modulator 100 includes a generally circular first or upper housing part 110 of a plastic material having a substantially cylindrical integral peripheral wall 112 extending downwardly from the circular top of the housing 110. The port 104 is formed on the outer end face of the housing part 110 and defines therein an axial passage 114 which extends axially through the housing part 110. The axially inner end of the passage 114 is surrounded by a tubular boss 116 formed on the inner surface of the housing part 110 and having an inner end face in which the inner end of the axial passage 114 is opened and which forms a valve seat 118. A generally annular second or intermediate housing part 120 of a similar plastic material is fitted into the bottom end of the annular recess 112' formed by the cylindrical wall 112 of the first housing part 110 and is sealingly secured to the cylindrical wall 112. The intermediate housing part 120 has an inner peripheral edge which is provided by an annular bead 122 to which the outer peripheral edge portion of a third or lower housing part 124 is sealingly secured. The lower housing part 124 is also molded from a similar plastic material and has a generally frusto-conical inner surface. The port 106 is integral with the lower housing part 124 and extends outwardly therefrom, the port 106 defining therein a second axial passage 126.

An annular fourth or inner housing part 128 of a similar plastic material is placed in the bottom of the annular recess 112' defined in the upper housing part 110. In the illustrated embodiment, the port 108 is integral with the inner housing part 128 and extends outwardly therefrom through an opening 110' formed in the top of the upper housing part 110. The port 108 defines therein a third axial passage 109. The outer and inner peripheral edges 130 and 132 of the inner housing part 128 project downwardly toward the intermediate housing part 120 so that a downwardly directed annular recess is formed in the intermediate housing part 128.

The pressure modulator 100 is provided with a diaphragm assembly 140 disposed within the housing 102 and comprising a spaced pair of diaphragms 142 and 144 which are connected together by a generally cup-shaped connecting member 146 so that the two diaphragms are upwardly or downwardly deformed in unison. More specifically, the first diaphragm 142 is generally annular and has an outer peripheral edge sealingly clamped between the outer peripheral edge 130 of the inner housing member 128 and the outer edge of the annular intermediate housing part 120. The inner peripheral edge portion of the first diaphragm 142 is generally cylindrical and sealingly clamped between the outer peripheral surface of the boss 116 of the upper housing part 110 and the inner peripheral surface of the inner housing part 128. The first diaphragm 142 cooperates with the inner surface of the annular inner housing part 128 to define a vacuum chamber 150 which is communicated with the venturi port 64 through the passage 109 and the vacuum line 62.

The second diaphragm 144 is of a disc-like shape and sealingly clamped at its outer edge between the inner peripheral edge 122 of the intermediate housing part 120 and the outer peripheral edge of the lower housing part 124. The second diaphragm 144 presents a pressure receiving surface area smaller than that of the first diaphragm 142 and cooperates with the lower housing part 124 to define an E.G.R. pressure chamber 152 which is communicated with the E.G.R. passage 16 downstream of the fixed restriction 32 through the passage 126 and the line 60. The first and second diaphragms 142 and 144 and the intermediate housing part 120 cooperate together to define a third chamber 154 in which the cup-shaped connecting member 146 is disposed and divides the chamber 154 into inner and outer sections which, however, are communicated with each other through apertures or openings 146' formed in the connecting member 146. The third chamber 154 is vented to the atmosphere through openings 120' formed in the intermediate housing part 120. The chamber 154 can be termed "atmospheric pressure chamber," accordingly.

The cup-shaped connecting member 146 has an annular outer flange portion which is secured to the underside of the annular first diaphragm 142. The bottom end of the connecting member 146 is also secured to the disc-like second diaphragm 144. A compression coil spring 156 is disposed within the cup-shaped connecting member 146 and extends between the boss 116 of the upper housing part 110 and the bottom of the cup-shaped connecting member 146 to resiliently bias the two diaphragms 142 and 146 downwardly away from the upper housing part 110.

The compression coil spring 156 surrounds the valve seat 118 provided by the inner end extremity of the boss 116. A valve member 158 formed of a simple generally circular piece having a flat top is disposed within the compression coil spring 156 in axially aligned relationship to the valve seat 118 and secured to the inner surface of the bottom of the cup-shaped connecting member 146 so that the valve member 158 is moved toward and away from the valve seat 118 as the diaphragm assembly 140 is shifted up and down in a manner which will be discussed later. A second compression coil spring 160 is preferably disposed in the E.G.R. pressure chamber 152 to bear the weight of the diaphragm assembly 140. In the case where the diaphragm assembly 140 is of a negligible weight, the second compression coil spring 160 can be omitted. An annular shock absorbing member or cushion 162 of an elastic material, such as rubber, is mounted on the top surface of the annular bead 122 of the intermediate housing part 120.

In operation, when the throttle valve 22 is in its idle position, the pressure at the port 56 is substantially equal to the atmospheric pressure. Thus, the pressure in the vacuum chamber 46 of the actuator 40 is also substantially equal to the atmospheric pressure, so that the diaphragm 50 is downwardly deformed by the compression spring 54 to move the valve member 42 into sealing engagement with the valve seat 34. Thus, the engine exhaust gases are not recirculated during the idle operation of the engine 10.

When the engine operation is accelerated to a speed corresponding to a part-open throttle position, the pressure at the port 56 in the carburetor 18 is of a vacuum level. This vaccum is transmitted through the vaccum line 54 toward the actuator 44 of the E.G.R. valve means 40. The vaccum which acts on the diaphragm 50 of the actuator 44 is modulated by the pressure modulator 100, as will be discussed hereunder.

The upper surface of the first diaphragm 142 of the pressure modulator 100 is subjected to the venturi vacuum at the port 64 in the carburetor 18, so that the venturi vacuum produces an upward force on the diaphragm 142 tending to lift the first diaphragm 142 upwards against the compression spring 156. On the other hand, the underside of the second diaphragm 144 of the pressure modulator 100 is subjected through the vacuum line 60 to the exhaust gas pressure in the E.G.R. passage 16 between the fixed restriction 32 and the E.G.R. valve means 40 (this exhaust gas pressure will be termed hereunder as "exhaust gas pressure downstream of the restriction 32"). The exhaust gas pressure downstream of the restriction 32 is kept at a generally constant vacuum level during a part-throttle engine operation at a substantially constant speed and under a substantially constant load on the engine. This is because, in this operating condition of the engine, the valve member 42 of the E.G.R. valve means 40 is maintained at a certain open position which is determined by the port vacuum as modulated by the pressure modulator 100. Namely, the pressure modulator 100 is arranged such that, during a throttle part-open engine operation, the venturi vacuum at the port 64 as applied to the first or larger diaphragm 142 and the exhaust gas pressure downstream of the restriction 32 as applied to the smaller diaphragm 144 are balanced and keep the diaphragm assembly 140 in a position in which the valve member 158 on the U-shaped connecting member 146 is slightly spaced from the valve seat 118 to allow the atmospheric air to flow from the chamber 154 into the passage 114 and thus into the vacuum line 54 to reduce the vacuum level of the port vacuum applied to the diaphragm 50 of the actuator 44.

Stated more specifically or exactly, the exhaust gas pressure downstream of the fixed restriction 32 is fluctuated even during a throttle part-open engine operation at a substantially constant speed and under substantially constant engine load. This is due to the pulsated discharge of the exhaust gases from the engine 10 into the exhaust pipe 14. When the exhaust gas pressure downstream of the restriction 32 rises momentarily, the pressure rise is transmitted through the vacuum line 60 to the second or smaller diaphragm 144 of the pressure modulator 100 so that the diaphragm assembly 140 therein is lifted to a position in which the valve member 158 is in sealing engagement with the valve seat 118. Thus, the vacuum as applied to the actuator 44 is increased because no atmospheric air is introduced by the modulator 100 into the vacuum line 54. Accordingly, the diaphragm 50 of the actuator 44 is lifted against the compression spring 54 to upwardly move the valve member 43 to thereby increase the exhaust gas flow cross-section of the E.G.R. passage 16, whereby the exhaust gas flow through the E.G.R. valve means 40 into the intake pipe 12 is increased and the exhaust gas pressure downstream of the restriction 32 is lowered to the initial pressure level. The operation described above will be cyclically repeated to maintain a generally constant exhaust gas pressure downstream of the fixed restriction 32 during a throttle part-open engine operation at a substantially constant engine speed and under a substantially constant engine load.

When the throttle valve 22 is moved to a new position to increase the flow of the intake air through the venturi 20, the vacuum at the port 64 is increased with a result that the diaphragm assembly 140 is lifed to a new position in which the increased venturi vacuum acting on the larger diaphragm 142 is balanced with the exhaust gas pressure downstream of the restriction 32 as applied to the smaller diaphragm 144. In this new position of the diaphragm assembly 140, the valve member 158 of the pressure modulator 100 is more close to the valve seat 118 than before, so that the rate of the flow of the atmospheric air through the pressure modulator 100 into the vacuum line 54 is decreased with a resultant increase in the vacuum level in the vacuum chamber 46 of the E.G.R. valve actuator 44 and thus increase in the degree of opening of the valve member 42 in the E.G.R. passage 16. This results in the decrease in the exhaust gas pressure downstream of the restriction 32 and thus in the increase in the pressure difference across the restriction 32. Accordingly, it will be noted that the pressure difference across the fixed restriction 32 is substantially in proportion to the venturi vacuum which is the function of the engine intake air flow.

The flow of the exhaust gas recirculation through the E.G.R. passage 16 is determined by the pressure difference across the fixed restriction 32. This differential pressure is varied in proportion to the variation in the venturi vacuum, as discussed above. Accordingly, the flow of the recirculated exhaust gases is substantially proportioned to the engine intake air flow.

Figure 3:
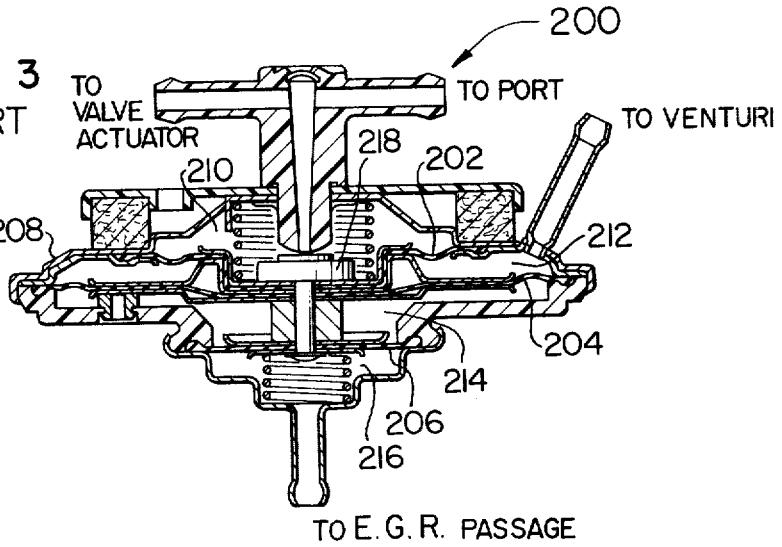
FIG. 3 PRIOR ART
FIG. 3 is a view similar to FIG. 2 but illustrates the prior art pressure modulator.

The pressure modulator 100 employed in the described embodiment 30 of the E.G.R. control system according to the present invention is compact in design, simplified in construction and can be manufactured at a reduced cost as compared with the prior art pressure modulator 200 shown in FIG. 3. More specifically, the modulator 200 uses a valve assembly consisting of three diaphragms 202, 204 and 206 disposed in a housing 208 so that four chambers 210, 212, 214 and 216 are formed within the housing 208. The first chamber 210 is an atmospheric pressure chamber which accomodates therein a pressure modulating valve member 218 movable with the valve assembly to modulate the port vacuum as applied to the E.G.R. valve actuator. The second chamber 212 is a vacuum chamber communicated with the venturi. The third chamber 214 is vented to the atmosphere, while the fourth chamber 216 is an E.G.R. pressure chamber communicated with the E.G.R. passage. The problem is that the vacuum chamber 212 is defined between the first and second diaphragms 202 and 204. The venturi vacuum applied to the vacuum chamber 212 is effective to produce a downward force on the first diaphragm 202 and an upward force on the second diaphragm 204, whereas the underside of the third diaphragm 206 is subjected to the exhaust gas pressure downstream of the fixed restriction (32). This exhaust gas pressure is of a substantially high vacuum level during a throttle part-open engine operation, as discussed previously. Accordingly, in order that the composite force acting on the pair of first and second diaphragms 202 and 204 may be balanced with the downward force acting on the third diaphragm 206, the second diaphragm 204 must provide a pressure receiving surface area which is substantially greater than that of the first diaphragm 202; namely, the difference in surface area between the second and first diaphragms must be as large as a few times of the surface area provided by the third diaphragm 206. Thus, the prior art pressure modulator 200 is inevitably large sized. This is an additional disadvantage of the prior art pressure modulator in addition to the complicated structure and increased cost of manufacture thereof due to the use of the three diaphragms. Moreover, the pressure modulator 100 used in the embodiment 30 of the present invention is advantageously light-weighted because all of the housing parts are made of a plastic material and can conveniently be assembled together by a conventional adhesive.

The embodiment 30 of the E.G.R. control system according to the present invention has been described as being used with an internal combustion engine 10 of the type that is equipped with a carburetor 18. The application of the present invention, however, is not limited to this type of engine. The system of the invention can also be used with another type of engine provided that the engine of the other type is equipped with means producing a vacuum which is the function of the engine intake air flow.

Figure 4:
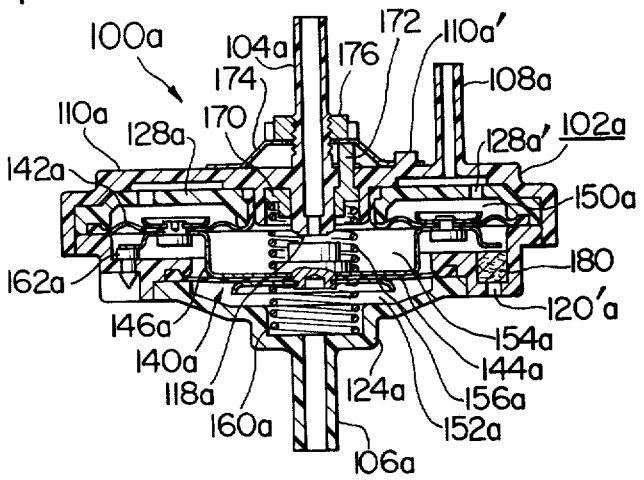
FIG. 4 is a view similar to FIG. 2 but illustrates a modification of the pressure modulator shown in FIGS. 1 and 2.
Figure 5:
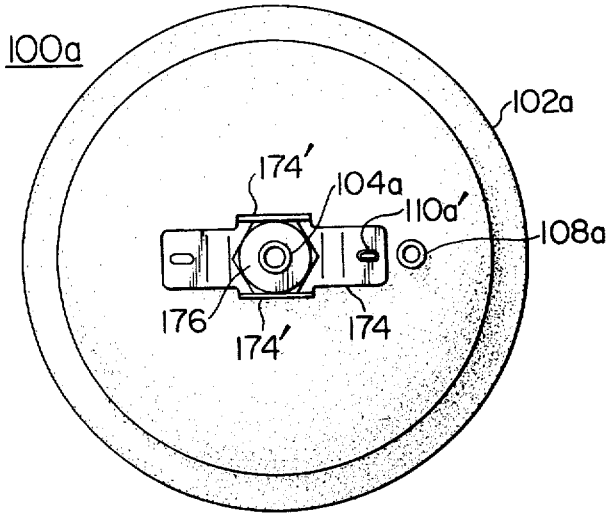
FIG. 5 is a top plan view of the modified pressure modulator shown in FIG. 4.

A modification **100*a* of the pressure modulator 100 is shown in FIGS. 4 and 5 wherein the parts similar to those shown in FIGS. 1 and 2 are designated by similar reference numerals followed by "a." The difference only will be discussed hereunder. The modified pressure modulator 100*a* is provided with means for adjusting the pressure to which the port vacuum to be applied to the E.G.R. valve actuator 44 is to be modulated. The pressure adjusting means includes a spring retainer 170 for a compression coil spring 156*a* which resiliently biases a diaphragm assembly 140*a* away from an upper housing part 110*a*. The spring retainer 170 is mounted on the inner surface of the upper housing part 110*a* for axial movement relative to the housing part 110*a* and has a plurality of legs one of which is shown by 172. The legs 172 extend outwardly through openings formed in the top of the upper housing part 110*a* and have outer ends in abutment engagement with the inner surface of a generally arcuate adjust plate 174 formed of a resilient sheet metal. The adjust plate 174 is elongated, as shown in FIG. 5, and has opposite end portions in engagement with the top of the upper housing part 110*a* and an intermediate portion upwardly spaced therefrom. The outer ends of the legs 172 of the spring retainer 170 are engaged with the inner surface of the intermediate portion of the adjust plate 174. The adjust plate 174 defines therein a slot through which a port 104*a* extends outwardly from the top of the upper housing part 110*a*. The port 104*a* is provided with external screw threads. A nut 176 is adjustably screwed over the external threads on the port 104*a* to move the spring retainer 170 until a required spring force is obtained from the compression spring 156*a*. When this state is attained, the side edges of the adjust plate 174** may preferably be bent upwardly to form upstanding flanges 174' which prevent the nut 176 from being inadvertently or accidentally loosened. The adjust plate 174 is also provided with a hole formed in one of the end portions thereof. The upper housing part 110*a* has a small projection 110*a*' extending upwardly from the top into engagement with the hole in the one end portion of the adjust plate 174 to prevent the same from being rotated relative to the housing part 110*a* when the nut 176 is rotated relative to the adjust plate 176.

A port 108*a*, which is adapted to be connected to the port 64 in the carburetor 18, is formed integrally with the upper housing part 110*a* rather than being formed on an inner housing part 128*a*. Instead, the latter is formed therein with apertures 128*a*' for the communication of the port 108*a* with a vacuum chamber 150*a*.

Openings 120'*a* of an atmospheric pressure chamber 154*a* are provided with air filter elements one of which is shown by 180.

What is claimed is:

1. In an E.G.R. control system of the type that comprises an E.G.R. valve means including a first valve seat provided in an E.G.R. passage of an internal combustion engine, a first valve member cooperative with said first valve seat to vary the exhaust gas flowing cross-section of said E.G.R. passage and a vacuum-operated actuator connected by a first pneumatic line to a first vacuum source provided by said engine, a fixed restriction provided in said E.G.R. passage upstream of said first valve seat, said actuator also being operatively connected to said first valve member to move the same relative to said first valve seat for thereby varying the exhaust gas pressure in said E.G.R. passage between said fixed restriction and said first valve seat, the improvement which comprises:

a pressure modulator provided on said first pneumatic line and being operative to modulate the vacuum applied to said valve actuator so that the exhaust gas recirculation flow as controlled by said E.G.R. valve means is substantially in proportion to the flow of the intake air into said engine;

said pressure modulator comprising:

a housing;

a diaphragm assembly movably disposed in said housing;

said diaphragm assembly including a pair of substantially parallel diaphragms and a member mechanically connecting said diaphragms together so that said diaphragms are deformed simultaneously;

one of said diaphragms being larger than the other;

said larger diaphragm cooperating with said housing to define a first chamber pneumatically connected by a second pneumatic line to a second vacuum source which provides a pressure signal representing the flow of the intake air into said engine;

said larger diaphragm cooperating with the smaller diaphragm and with said housing to define a second chamber vented to the atmosphere; said smaller diaphragm cooperating with said housing to define a third chamber connected by a third pneumatic line to said E.G.R. passage between said fixed restriction and said first valve seat;

means defining a pressure modulating passage pneumatically connecting said second chamber to said first pneumatic line between the ends thereof;

said passage defining means also providing a second valve seat disposed in said second chamber and extending around the inner end of said pressure modulating passage;

spring means resiliently biasing said diaphragm assembly away from said first chamber towards said third chamber;

a second valve member disposed in said second chamber in opposite relationship to said second valve seat;

said second valve member being carried by said diaphragm assembly for movement therewith toward and away from said second valve seat, whereby said second valve member is operative to control the flow of the atmospheric air from said second chamber through said second valve seat and said pressure modulating passage into said first pneumatic line to thereby modulate the vacuum from said first vacuum source as applied to said actuator.

2. The improvement according to claim 1, wherein said housing is generally top-shaped and has larger and smaller end walls and a generally frusto-conical peripheral wall, said larger and smaller end walls being adjacent to said first and third chambers, respectively, said housing having a boss formed on the inner surface of said larger end wall, said pressure modulating passage extending through said boss axially thereof, said second valve seat being provided by the inner end face of said boss, said first diaphragm being annular and having an inner periphery sealingly secured to the inner surface of said larger end wall around said boss.

3. The improvement according to claim 2, wherein said connecting member is generally cup-shaped and has an outer peripheral edge portion secured to said larger diaphragm and a bottom portion secured to said smaller diaphragm, said second valve member being mounted on the inner surface of the bottom portion of said connecting member.

4. The improvement according to claim 3, wherein said spring means comprises a first compression coil spring disposed in said second chamber and surrounding said second valve seat and said second valve member.

5. The improvement according to claim 4, wherein a second compression spring is disposed in said third chamber and extends between said smaller end wall and said second diaphragm.

6. The improvement according to claim 4, wherein said pressure modulator further includes means for adjusting the spring force of said first compression coil spring acting on said diaphragm assembly, said spring force adjusting means including a spring retainer movably mounted on the inner surface of said larger end wall of said housing and receiving the end of said first compression coil spring adjacent to said larger end wall of said housing and means for adjusting the position of said spring retainer relative to said larger housing end wall.

7. The improvement according to claim 1, 2, 3, 4, 5 or 6, wherein said housing is made of a plastic material.

* * * * *